US005110132A

United States Patent [19]

Weston et al.

[11] Patent Number: 5,110,132

[45] Date of Patent: May 5, 1992

[54] ALIGNMENT APPARATUS FOR GOLFERS

[76] Inventors: Tracy Weston; Joe H. Juren, both of 11 Sugar Creek Dr., Austin, Tex. 78746

[21] Appl. No.: 709,896

[22] Filed: Jun. 4, 1991

[51] Int. Cl.[5] ..... A63B 69/36

[52] U.S. Cl. ..... 273/187 R; 33/508; 33/418

[58] Field of Search ..... 273/187 R, 183 R, 183 A, 273/183 E; 33/508, 429, 418

[56] References Cited

U.S. PATENT DOCUMENTS

| | | | |
|---|---|---|---|
| 1,208,995 | 12/1916 | Lyon | 33/508 X |
| 1,781,230 | 11/1930 | Hill | 273/187 R |
| 2,025,519 | 12/1935 | Lingg | 33/508 |
| 4,718,674 | 1/1988 | Henry | 273/187 R X |

FOREIGN PATENT DOCUMENTS

| | | | |
|---|---|---|---|
| 17666 | of 1915 | United Kingdom | 273/187 R |
| 2100607 | 1/1983 | United Kingdom | 273/187 R |

*Primary Examiner*—George J. Marlo

*Attorney, Agent, or Firm*—J. Nevin Shaffer, Jr.; Russell D. Culbertson

[57] ABSTRACT

An alignment apparatus and method having three long sections and one short section joined together so that when opened in the proper position, a square is formed. One long section serves as a target pointer, a second long section serves as the ball pointer, and a third long section serves as a body alignment guide. The sections of the invention are joined together in a rotatable fashion so that the device may be opened or closed easily and transported in a golf bag, if desired. When the device is used, one section is pointed at the target, one section is pointed at the golf ball, and the third section forms a reference for positioning of the golfer's feet. The section of the device pointed at the target has an elongated section that serves as a guide for take away of a golf club in a direction directly opposite from the target, as is desired. The portion of the long section pointed at the golf ball also has an elongated end that serves as a reference point for the alignment of the ball to the golfer's body. Further, that elongated end also serves as a reference point for the positioning of the golfer's hands, in front of or behind the ball. Finally, an elongated end on the third long section provides a reference point for the user's feet, either parallel to the line of flight, open to it, or closed to it.

2 Claims, 1 Drawing Sheet

ALIGNMENT APPARATUS FOR GOLFERS

BACKGROUND OF THE INVENTION

This invention relates to an improved alignment apparatus and method for aligning a ball with a target and a user with a ball.

The mystery surrounding the art and science of hitting a target with a thrown or propelled object has perplexed mankind since the Stone Age. Because of advances in technology and equipment, many of the excuses for not hitting a target have been removed from a layman's arsenal. Perhaps the greatest single obstacle yet to be overcome in this age-old quest for accuracy is the problem of alignment. The most advanced carbon graphic shaft and the most aerodynamically pure shape are of no avail if you are not properly aligned with the target.

Golf. A simple word that incorporates into it a vast array of historical, physical, and emotional highs and lows. In most sports, just hitting the ball solves most of the problems. In golf, however, hitting the ball is less than half of the problem. It still remains to have selected the correct club for the proper distance and ultimately to hit the desired target. Golf, then, requires the proper alignment of club, ball, target, and body, much more so than many other sports.

The problem of alignment in golf has been addressed probably since the first golfer took out a club and selected his target. Various "solutions" have been suggested. Some teach taking an additional club from the bag and laying it along the line of intended flight. This helps in the solution of the direction of the ball towards the target. Other problems still exist. Should the ball be placed forward or back in the stance? Should the feet be open or closed to the target? Other problems arise In particular, golf pros suggest that the club be taken away from the ball along a straight line directly away from the ball. Impossible to achieve while executing a correct golf swing, since the club must move behind the ball at some point, but at least the initial few inches, it is suggested, should be taken "straight back".

A drawback to the "solutions" offered by the prior art is that they may address one of the alignment problems, discussed above, but very rarely more than one, and none, as far as this inventor knows, address each of the problems with a single device. Thus, there is a need in the art for providing an alignment apparatus and method which simply and easily provides alignment guides for ball placement relative to body, to target direction, to take away alignment, and to foot placement. It, therefore, is an object of this invention to provide an alignment apparatus and method for simply and easily providing alignment guides for feet, target, ball, body, hands, etc.

SHORT STATEMENT OF THE INVENTION

Accordingly, the alignment apparatus and method of the present invention includes, in one embodiment, a first pointer, for pointing at the target, a second pointer, for pointing at the ball and connected to the first pointer, and a guide that is attached to the second pointer and is spaced apart from and is parallel to the first pointer.

In particular, the invention includes a first long section that is connected perpendicularly at one end to one end of a second long section. A third long section is connected perpendicularly at one end to one end of a short section and the third long section is connected perpendicularly to the second long section so that a square is formed, equal in length to the short section. The short section is also connected perpendicularly to the first long section. Importantly, the connections are movable so that the device can collapse into an easily portable shape that is, in general, no larger than an average golf club.

A preferred embodiment of the device further includes elongated ends on each of the long sections for use in guiding a club head on take away, for placement in positioning of the ball relative to a user's body, and for placement of the user's feet relative to the target.

The invention may be formed from any suitable material, wood, plastic, metal, or the like. Further, the sections from the which the device is constructed, both short and long, are four-sided rectangular shapes with opposed flat surfaces. The top and bottom sides are longer than the opposed side sections are wide so that a long, thin, rectangular shape is formed.

BRIEF DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
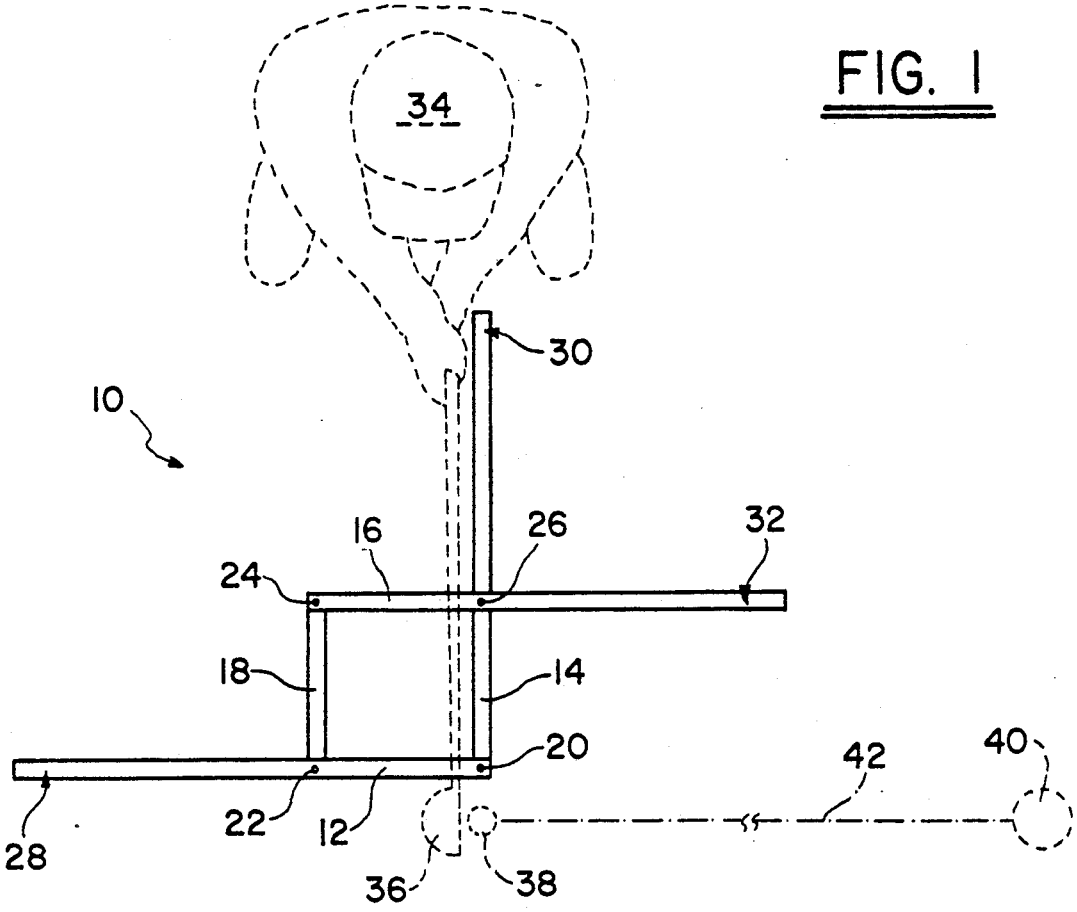
FIG. 1 is an overhead view of a preferred embodiment of the alignment apparatus of the present invention, with a user and a user's golf club shown in dotted lines.
Figure 2:
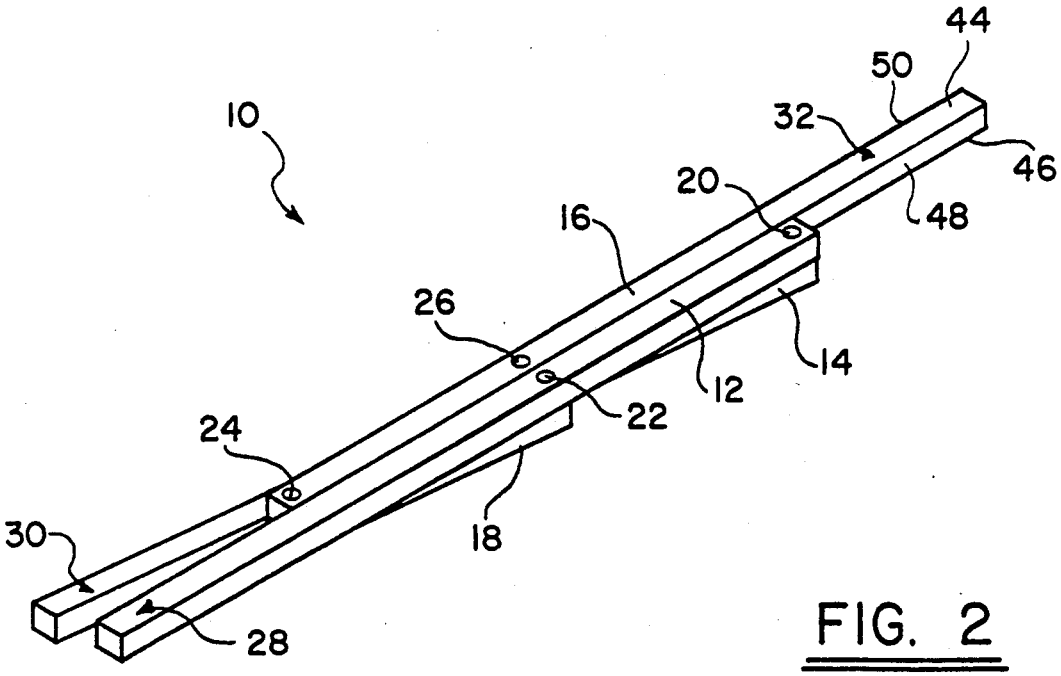
FIG. 2 is a plan view showing the invention in its collapsed, portable state.

The preferred embodiment of the present invention is illustrated by way of example in FIGS. 1–2. With specific reference to FIG. 1, alignment device 10 is composed of three long sections 12, 14, and 16, and one short section 18. As illustrated, these sections are joined by moveable connections 20, 22, 24, and 26. Connections 20, 22, 24, and 26 may be of any type known in the art that allows sections 12, 14, 16 and 18 to move.

Each long section, 12, 14, and 16, has an elongated end 28, 30, and 32, respectively. Importantly, when the device is properly positioned, a square of the size of short section 18 is formed.

User 34 is shown holding club 36 and addressing ball 38. FIG. 1 also illustrates target 40 and a dotted line 42 indicating the direction from alignment device 10 to target 40.

Referring now to FIG. 2, device 10 is shown in its collapsed state. This view clearly illustrates that alignment device 10 is comprised of sections, both long and short, that are rectangular in shape with opposed flat surfaces. The top 44 and bottom 46 (not shown) are long, flat surfaces, while opposed sides 48 and 50 (not shown) are less wide than the top and bottom sides are long, so that a long, thin, rectangular shape is formed.

In operation, user 34 removes collapsed alignment device 10, as shown in FIG. 2, from his golf bag and proceeds to the practice tee. At the practice tee, user 34 identifies target 40. Opening alignment device 10 until a square is formed, user 34 takes long section 12 and points moveable connection 20 generally at target 40. Long section 12 has now become the target pointer of the device. Elongated end 28 of long section 12 serves an additional function as well. Elongated end 28 serves as a guide for user 34 to draw club 36 along at the start of his back swing. Because the long section 12 is pointed at target 40, elongated end 28 forms a line directly away from the target along which the proper golf club take away must begin.

User 34, having pointed long section 12 at target 40, must next point long section 14 at golf ball 38. Aligning moveable connection 20 so that the end of long section 14 points at the ball makes long section 14 the ball pointing section that provides several alignment advantages to the golfer 34. First, a proper alignment has the ball located somewhat left of the middle of the golfer's body for a normal swing. Elongated end 30 points directly at the user 34 and enables proper alignment of the ball on the body with a visual reference. Additionally, user 34 can ensure that his or her hands are ahead or behind the ball 38, as desired, by noting their position relative to elongated end 30.

Long section 16 also provides critical alignment information to user 34. As a general rule, a golfer's 34 feet should be aligned parallel to the line of flight. Because elongated end 32 of long section 16 provides a ready reference parallel to the line of flight, ball to target, a golfer's stance can readily be corrected. Further, should an open stance, with the left foot farther back from elongated end 32, or a closed stance, with the left foot closer to elongated end 32, be desired, either can easily be established.

In summary, the simple four-piece, four-hinge construction of alignment device 10 results in an economical and practical device. In particular, the long, thin sections allow the device to fold neatly, as shown in FIG. 2, and enables it to be placed easily within a golfer's bag. Further, because the device is thin, it does not obstruct the golfer's view of the golf ball, nor interfere with the swing of the club in any way. Having opened the device 10, user 34 simply points one end at the target, and the same end perpendicular to that one end at the ball. Assuring that a square has been formed with short side 18, relative to long sections 12, 14, and 16, ensures that elongated ends 28, 30, and 32, are properly positioned for useful reference, as previously described. Once training is completed, the device may be recollapsed and inserted in the golf bag for future use. While the alignment device of the present invention has been disclosed in connection with golf alignment concerns, it should be appreciated that the alignment device can be used in other arenas, such as baseball, for one example.

While the present invention has been disclosed in connection with the preferred embodiment thereof, it should be understood that there may be other embodiments which fall within the spirit and scope and the invention as defined by the following claims.

I claim:

1. An alignment apparatus for golfers comprising:

(a) three long sections and one short section rotatably and collapsibly joined and defining a reference square positioned adjacent a golf ball showing a user that said sections are in proper relation to each other and said golf ball;

(b) a first long section for pointing at a target which provides alignment feedback to said user for taking a golf club back along a line away from said target and for aligning said club in the direction of said target when swinging said club;

a second long section extending perpendicular to said first long section and having one and thereof pointing toward said user, stopping short of said user's feet, and the second end thereof pointing at said golf ball which provides alignment feedback for the user's body and hands as being ahead of or behind said ball;

(d) a third long section parallel to said first long section and perpendicular to said second long section for providing alignment feedback for said user's feet as being open or closed to said target, and said one short section joining said first and third long sections to complete said reference square.

2. The apparatus of claim 1 wherein said sections, long and short, each comprise a four-sided rectangular shape with opposed flat surfaces and top and bottom sides longer than opposed side sections are wide so that a long, thin, rectangular shape is formed.

* * * * *